US007411131B2

(12) United States Patent
Stutzman

(10) Patent No.: US 7,411,131 B2
(45) Date of Patent: Aug. 12, 2008

(54) TWISTED PAIRS CABLE WITH SHIELDING ARRANGEMENT

(75) Inventor: Spring Stutzman, Sidney, NE (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 11/473,370

(22) Filed: Jun. 22, 2006

(65) Prior Publication Data

US 2007/0295527 A1 Dec. 27, 2007

(51) Int. Cl.
*H01B 11/02* (2006.01)

(52) U.S. Cl. ..... 174/113 R; 174/113 C

(58) Field of Classification Search ..... 174/113 R, 174/113 C, 36

See application file for complete search history.

(56) References Cited

U.S. PATENT DOCUMENTS

| | | | | |
|---|---|---|---|---|
| 2,556,244 | A | 6/1951 | Weston | |
| 4,356,346 | A * | 10/1982 | Sakabe | 174/130 |
| 5,286,923 | A | 2/1994 | Prudhon et al. | |
| 5,952,615 | A | 9/1999 | Prudhon | |
| 6,248,954 | B1 | 6/2001 | Clark et al. | |
| 6,288,340 | B1 | 9/2001 | Arnould | |
| 6,506,976 | B1 | 1/2003 | Neveux, Jr. | |
| 6,566,605 | B1 | 5/2003 | Prudhon | |
| 6,624,359 | B2 | 9/2003 | Bahlmann et al. | |
| 6,743,983 | B2 | 6/2004 | Wiekhorst et al. | |
| 6,787,697 | B2 | 9/2004 | Stipes et al. | |
| 6,812,408 | B2 | 11/2004 | Clark et al. | |
| 6,875,928 | B1 | 4/2005 | Hayes et al. | |
| 6,998,537 | B2 | 2/2006 | Clark et al. | |
| 2001/0040042 | A1 | 11/2001 | Stipes | |
| 2003/0106704 | A1 | 6/2003 | Isley et al. | |
| 2004/0055777 | A1 | 3/2004 | Wiekhorst et al. | |
| 2004/0055779 | A1 | 3/2004 | Wiekhorst et al. | |
| 2004/0055781 | A1 | 3/2004 | Cornibert et al. | |
| 2004/0124000 | A1 | 7/2004 | Stipes et al. | |
| 2005/0103518 | A1 * | 5/2005 | Glew | 174/113 R |
| 2006/0118322 | A1 | 6/2006 | Wiekhorst et al. | |
| 2006/0169479 | A1 * | 8/2006 | Dillon et al. | 174/113 R |

FOREIGN PATENT DOCUMENTS

| | | |
|---|---|---|
| GB | 356899 | 9/1931 |

* cited by examiner

*Primary Examiner*—Chau N Nguyen
(74) *Attorney, Agent, or Firm*—Merchant & Gould P.C.

(57) ABSTRACT

A multi-pair cable having a plurality of twisted conductor pairs and a shielding arrangement. The shielding arrangement including at least one shielding component. The shielding component including a length of tape encased by a dielectric material.

25 Claims, 4 Drawing Sheets

TWISTED PAIRS CABLE WITH SHIELDING ARRANGEMENT

TECHNICAL FIELD

The present disclosure relates generally to cables for use in the telecommunications industry, and various methods associated with such cables. More particularly, this disclosure relates to a multi-pair cable for use in the telecommunications industry.

BACKGROUND

A wide variety of cable arrangements having twisted conductor pairs are utilized in the telecommunications industry. In some cable arrangements, the twisted conductor pairs are separated by one or more filler components. In yet other arrangements, the cable includes shielding that surrounds the twisted conductor pairs, and the one or more filler components. The shielding reduces the occurrence of crosstalk between adjacent cables and thereby improves signal transmission performance of the twisted conductor pairs.

Cable shielding is commonly provided in the form of a conductive tape. The conductive tape surrounds the entire circumference of the cable core (i.e., the twisted conductor pairs, and the filler) to provide complete cable shielding. In particular, the conductive tape is wrapped around the entire cable core in an overlapping manner such that no gaps exist. Such shielded cables are expensive, typically require grounding, and further require specific connectors that accommodate the shielding.

In general, improvement has been sought with respect to existing cable assemblies, generally to reduce costs associated with twisted pair cables, and improve signal transmission performance of twisted pair cables.

SUMMARY

The present disclosure relates to a multi-twisted pair cable. The cable generally includes a plurality of twisted conductor pairs and a jacket that covers the twisted conductor pairs. The multi-twisted pair cable also includes a shielding arrangement configured to reduce manufacturing costs while improve cable performance. The shielding arrangement includes at least one shielding component having a length of aluminum tape encased in a dielectric material.

A variety of examples of desirable product features or methods are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Reference will now be made in detail to various features of the present disclosure that are illustrated in the accompanying drawings. Wherever possible, the same reference numbers will be used throughout the drawings to refer to the same or like parts.

Figure 1:
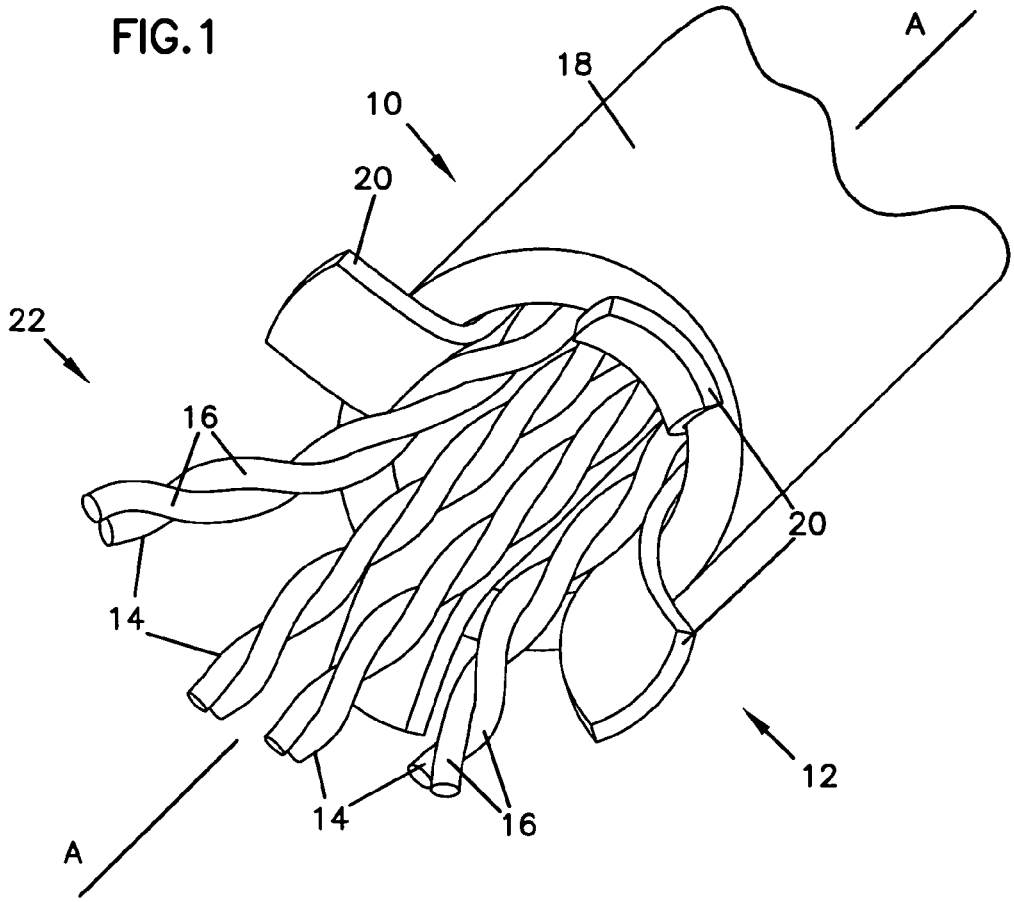
FIG. 1 is a perspective view of a first multi-pair cable, shown with a first shielding arrangement embodiment, according to the principles of the present disclosure.

FIG. 1 illustrates a multi-pair cable 10 including one embodiment of a shielding arrangement 12 having features that are examples of how inventive aspects in accordance with the principles of the present disclosure may be practiced. Preferred features of the cable 10, and the presently disclosed shielding arrangement embodiments, are adapted to reduce the cost of multi-pair cables and yet improve the signal transmission performance of the cables.

Referring to FIG. 1, in general, the multi-pair cable 10 includes a central cable core 22 having a longitudinal axis A. The central cable core 22 is at least partially defined by a plurality of twisted conductor pairs 14. Each of the twisted conductor pairs 14 includes two insulated conductors 16 twisted about one another along a longitudinal axis of the pair.

The multi-pair cable 10 includes a jacket 18 that covers or surrounds the central cable core 22. The jacket 18 may be of a solid annular construction, as shown in FIG. 1, or may alternatively be channeled to reduce material costs and/or provide a desired dielectric characteristic. In one embodiment, the jacket 18 is made of a non-conductive material such as polyvinyl chloride (PVC), for example. Other types of non-conductive materials can also be used for the jacket, including other plastic materials such as fluoropolymers (e.g. ethylenechlorotrifluorothylene (ECTF) and Flurothylenepropylene (FEP)), polyethylene, or other electrically insulating materials.

While the cable 10 of FIG. 1 is illustrated with a first embodiment of the shielding arrangement 12, it is to be understood that the above general description of the cable 10 also applies to the cables having other shielding arrangement embodiments described in detail hereinafter.

Figure 2:
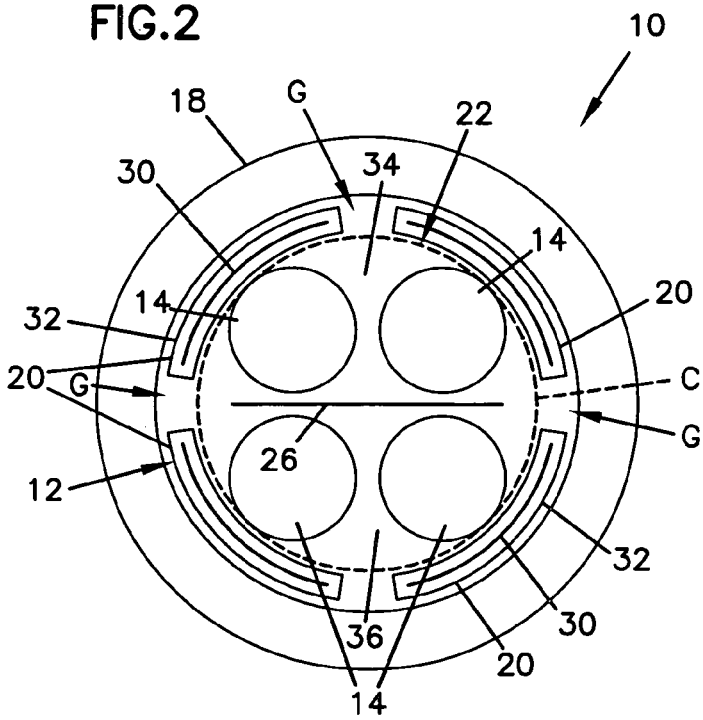
FIG. 2 is a schematic, cross-sectional view of the multi-pair cable of FIG. 1.

Referring to FIG. 2, the cable core 22 of the multi-pair cable 10 further includes a spacer or filler 26. The filler 26 separates the twisted conductor pairs 14. In the illustrated embodiment, the filler 26 defines two regions: a first region 34 that receives two twisted conductor pairs, and a second region 36 that receives two other twisted conductor pairs. As will be described in greater detail hereinafter, the filler can be configured to define more than two regions; for example, the filler may define four regions or pockets that are sized to receive individual twisted conductor pairs. In manufacture, the filler 26 may be pulled straight along the length of the cable core 22; that is, the filler 26 may run along the length of the cable 10 without twisting about the longitudinal axis A of the cable 10. In the alternative, it is contemplated that the filler 26 may helically twist, at a constant or varying twist rate, about the longitudinal axis A of the cable 10.

Referring still to FIG. 2, preferably the first shielding arrangement 12 only partially covers a circumference C of the cable core 22 of the cable 10. The circumference C of the cable core 22 is the circumference defined by the outer boundaries of the twisted conductor pairs 14 and the filler 26; i.e., the circumference which circumscribes the twisted conductor pairs and the filler.

In conventional cable arrangements, tape, for example, is often helically wound around the cable core in an overlapping manner so that the cable core is completely shielded. While this may be advantageous in some applications, it is also very costly for use in applications where complete shielding is unnecessary. The presently disclosed cables with shielding arrangement embodiments of FIGS. 1-9 are less expensive than cables having complete shielding arrangements, yet still reduce the occurrence of crosstalk between adjacent cables to improve signal transmission performance.

As shown in FIG. 2, the shielding arrangement 12 includes a plurality of separate or discrete shielding components 20. The shielding components 20 are located radially beyond the twisted conductor pairs 14 and extend along the entire length of the cable. Gaps G are located between each of the shielding components 20 such that the circumference C of the cable core 22 is only partially covered.

The gaps G reduce the amount of material required to manufacture the cable, and accordingly reduce the costs of the cable. In addition to providing a cost effective solution to crosstalk, the reduced amount of cable material that makes up the shielding arrangement correspondingly reduces the amount or propagation of flames and smoke. The present shielding arrangement 12 thereby also enhances the flame retardant quality of the cable 10.

Referring still to FIG. 2, each of the shielding components 20 includes a length of aluminum tape 30 encased in or surrounded by a dielectric material 32 (e.g., a dielectric casing). Aluminum tape is one example of the type of shielding material that can be used. Other metallic materials and/or constructions adapted for blocking electromagnetic radiation, such as a copper foil tape or screen, a metallic braid shield, or a corrugated metal shield can also be used in accordance with the principles disclosed.

Preferably, the aluminum tape 30 is completely surrounded by the dielectric casing or material 32 so that no portion of the aluminum tape 30 is exposed. The encased aluminum tape 30 of the shielding arrangement blocks crosstalk between adjacent cables. The dielectric material 32 also allows the cable to be provided without a ground. In one method of making the shielding components 20, the length of aluminum tape 30 is extruded along with the dielectric material 32 to form the shielding component.

Prior to assembly, the shielding components 20 have a generally planar or flat cross-section. The shielding components are of a generally flexible construction. The flexible construction permits the shielding components 20 to flex or bend into an arcuate shape to accommodate the presence of the jacket 18, as shown in FIG. 2, while not cutting into or damaging the jacket 18.

In the illustrated embodiment of FIG. 2, the shielding arrangement 12 of the multi-pair cable 10 includes four separate or discrete shielding components 20. The discrete shielding components 20 each correspond to one of the twisted conductor pairs. In one method of manufacture, the shielding components 20 are pulled straight along the length of the cable core 22; that is, the shielding components 20 run along the length of the cable 10 without twisting about the longitudinal axis A of the cable 10. In the alternative, it is contemplated that the shielding components 20 may helically twist, at a constant or varying twist rate, about the longitudinal axis A of the cable 10.

Further, the shielding components 20 may run straight or twist independent of the cable core 22. For example, the shielding components 20 may extend along the length of the cable 10 in a corresponding association with the twisted conductor pairs 14 such that each shielding component runs with a particular one of the twisted conductor pairs 14. That is, each of the matched shielding component 20 and the twisted conductor pair 14 may run together or in concert along the length of the cable 10 in either a twisting configuration, or in a straight run configuration. In the alternative, the cable core 22 may twist, while the shielding components 20 run straight; or the cable core 22 may run straight, while the shielding components 20 twist.

Figure 5:
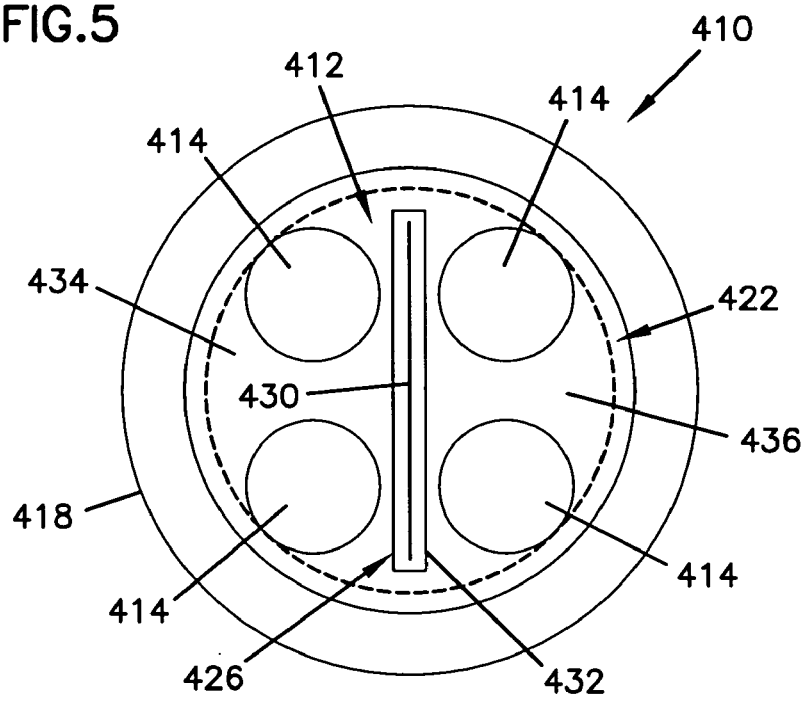
FIG. 5 is a schematic, cross-sectional view of a fourth multi-pair cable similar to that of FIG. 1, and shown with a fourth shielding arrangement embodiment, according to the principles of the present disclosure.

The filler 26 of the cable core 22 can be manufactured as a solid extrusion of dielectric material. In the alternative, the filler 26 may be constructed in a similar manner as that of the shielding components 20 of the shielding arrangement 12. In particular, the filler 26 may be constructed to include a length of encased aluminum tape. One such filler embodiment is illustrated in FIG. 5. Referring to FIG. 5, a cable 410 having a filler 426 with a length of aluminum tape 430 encased in or surrounded by a dielectric material 432 is shown. Similar to the previously described shielding components (e.g., 20), the aluminum tape 430 of the filler 426 is completely surrounded by the dielectric material so that no portion of the aluminum tape 430 is exposed. Both the filler 16 of the solid extrusion of dielectric material and the encased aluminum tape filler 426 allows the cable 10, 410 to be provided without a ground. In the alternative, the filler 26 can be defined by a length of non-encased or exposed aluminum tape, in which case a ground wire may be provided.

FIGS. 3-9 illustrate other embodiments that are examples of how inventive aspects in accordance with the principles of the present disclosure may be practiced. Many of the features and principles previously disclosed in reference to the first shielding arrangement embodiment 12 of FIG. 2 apply similarly to the embodiments of FIGS. 3-9 hereinafter described.

Figure 3:
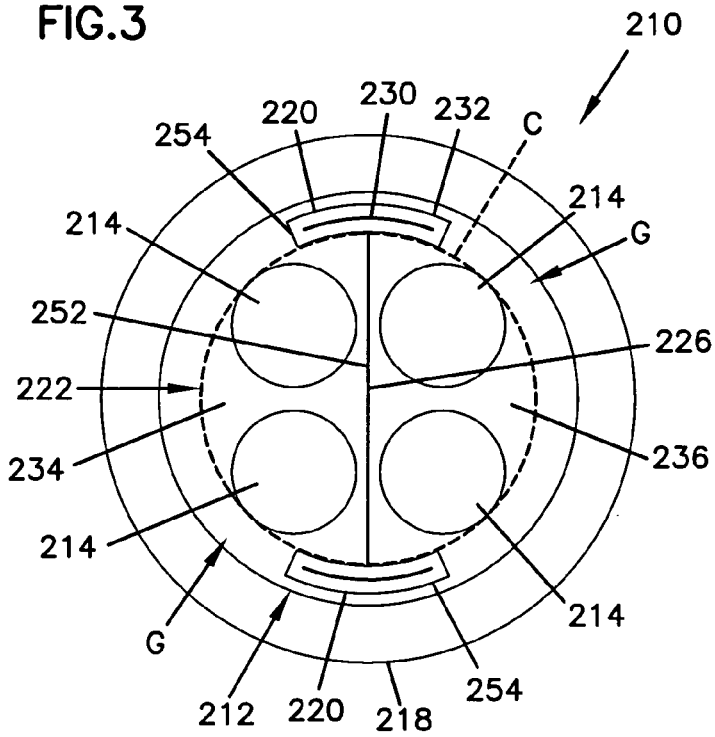
FIG. 3 is a schematic, cross-sectional view of a second multi-pair cable similar to that of FIG. 1, and shown with a second shielding arrangement embodiment, according to the principles of the present disclosure.

Referring to FIG. 3, a multi-pair cable 210 having a second shielding arrangement 212 embodiment is illustrated. Similar to the previous embodiment, the cable 210 includes a central cable core 222 at least partially defined by a plurality of twisted conductor pairs 214. A jacket 218 covers or surrounds the central cable core 222. The cable core 222 of the multi-pair cable 210 further includes a spacer or filler 226. The filler 226 separates the twisted conductor pairs 214. In the illustrated embodiment, the filler 226 defines two regions: a first region 234 that receives two twisted conductor pairs, and a second region 236 that receives two other twisted conductor pairs.

The second shielding arrangement 212 includes a plurality of separate or discrete shielding components 220. The shielding components 220 extend along the entire length of the cable. Gaps G are located between each of the shielding components 220 such that the shielding arrangement 212 only partially covers a circumference C of the cable core 222. Each of the shielding components 220 includes a length of aluminum tape 230 encased in or surrounded by a dielectric material 232 (e.g., a dielectric casing). The aluminum tape of the shielding arrangement blocks crosstalk between adjacent cables. The dielectric material 232 allows the cable to be provided without a ground.

The shielding arrangement 212 of the multi-pair cable 210 includes two separate or discrete shielding components 220. The two discrete shielding components 220 are located on opposite sides of the cable core 222; that is, the shielding components 220 are spaced approximately 180 degrees apart, although the components can be unequally spaced apart as well. In the illustrated embodiment of FIG. 3, the discrete shielding components 220 are interconnected to one another by the filler 226. That is, the shielding arrangement 212 of the present cable 210 incorporates or is integral with the filler 226 of the cable core 222. In the alternative, the filler 226 both separates the individual twisted conductor pairs 214 and provides shielding to reduce crosstalk between adjacent cables.

Still referring to FIG. 3, the filler 226 can be described as an I-shaped filler having a central portion 252 and transverse shielding portions 254 defined by the shielding components 220. The transverse shielding portions 254 are located radially beyond the twisted conductor pairs 214. As previously described, the shielding components 220 have a generally planar or flat cross-section; and are generally flexible to permit the components to flex or bend.

In one method of making, the length of aluminum tape 230 is extruded along with the dielectric material 232 to form the transverse shielding portions 254. The central portion 252 of the filler 226 in the illustrated embodiment is manufactured as a solid extrusion of dielectric material, however, the central portion 252 may also be constructed to include a length of encased aluminum tape, as described with regards to FIG. 5.

Similar to the previous embodiment, in one method of manufacture, the filler 226 is pulled straight along the length of the cable core 222 such that the shielding components 220 (or the transverse shielding portions 254) run along the length of the cable 210 without twisting about the longitudinal axis A (FIG. 1) of the cable. In the alternative, the filler 226 and the shielding components 220 may helically twist, at a constant or varying twist rate, about the longitudinal axis A of the cable.

Figure 4:
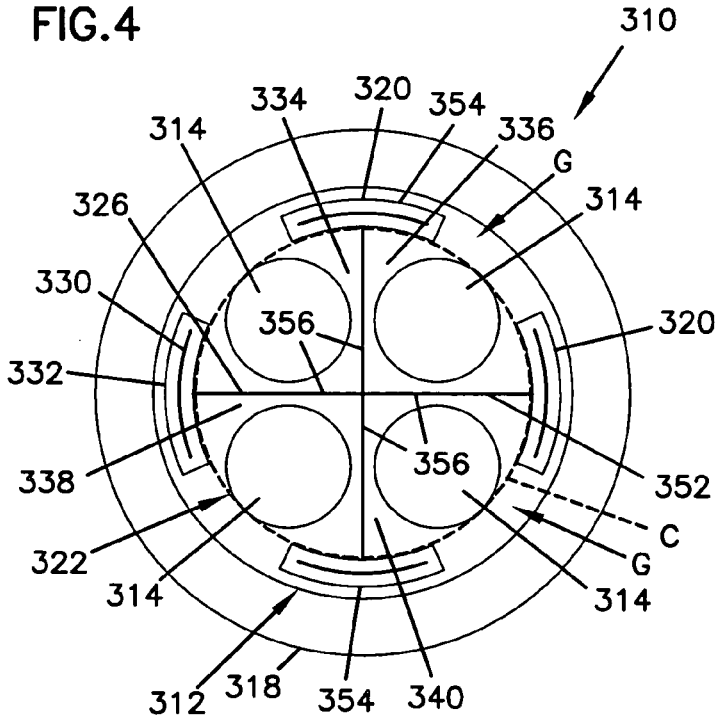
FIG. 4 is a schematic, cross-sectional view of a third multi-pair cable similar to that of FIG. 1, and shown with a third shielding arrangement embodiment, according to the principles of the present disclosure.

Referring now to FIG. 4, a multi-pair cable 310 having a third shielding arrangement embodiment 312 is illustrated. Similar to the previous embodiments, the cable 310 includes a central cable core 322 at least partially defined by a plurality of twisted conductor pairs 314. A jacket 318 covers or surrounds the central cable core 322. The cable core 322 of the multi-pair cable 310 further includes a spacer or filler 326. The filler 326 separates the twisted conductor pairs 314.

In the illustrated embodiment of FIG. 4, the filler 326 defines four regions or pockets, including a first region or pocket 334, a second region or pocket 336, a third region or pocket 338, and a fourth region or pocket 340. Each of the pockets 334, 336 338, 340 is sized to receive only one of the twisted conductor pairs.

The shielding arrangement 312 includes a plurality of separate or discrete shielding components 320. The shielding components 320 extend along the entire length of the cable. Gaps G are located between each of the shielding components 320 such that a circumference C of the cable core 322 is only partially covered. Each of the shielding components 320 includes a length of aluminum tape 330 encased in or surrounded by a dielectric material 332 (e.g., a dielectric casing). The aluminum tape of the shielding arrangement blocks crosstalk between adjacent cables. The dielectric material 332 allows the cable to be provided without a ground.

The shielding arrangement 312 of the multi-pair cable 310 includes four separate or discrete shielding components 320. In the illustrated embodiment of FIG. 4, the discrete shielding components 320 are interconnected to one another by the filler 326. That is, the shielding arrangement 312 of the present cable 310 incorporates or is integral with the filler 326 of the cable core 322. In the alternative, the filler 326 both separates the individual twisted conductor pairs 314 and provides shielding to reduce crosstalk between adjacent cables.

Still referring to FIG. 4, the filler 326 is star-shaped or cross-shaped and includes a central portion 352 having a plurality of legs 356 that define the pockets 334, 336, 338, 340 of the filler 326. Transverse shielding portions 354, defined by the shielding components 320, are located radially beyond the twisted conductor pairs 314, at the ends of the legs 356. As previously described, the shielding components 320 have a generally planar or flat cross-section prior to assembly; and are generally flexible to permit the components to flex or bend. In one method of making, the length of aluminum tape 330 is extruded along with the dielectric material 332 to form the transverse shielding portions 354.

Figure 6:
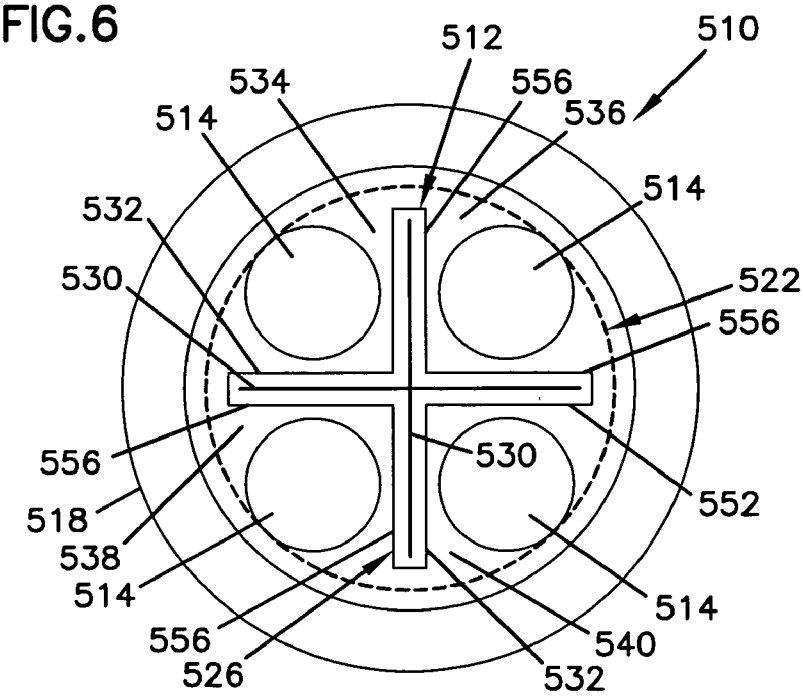
FIG. 6 is a schematic, cross-sectional view of a fifth multi-pair cable similar to that of FIG. 1, and shown with a fifth shielding arrangement embodiment, according to the principles of the present disclosure.

While the legs 356 of the central portion 352 in the illustrated embodiment are of a solid extrusion of dielectric material, the legs 356 may also be constructed to include a length of encased aluminum tape. One such filler embodiment is illustrated in FIG. 6. Referring to FIG. 6, a cable 510 having a star-shaped filler 526 with lengths of aluminum tape 530 encased in or surrounded by a dielectric material 532 is shown. Similar to the previously described shielding components (e.g., 320), the lengths of aluminum tape 530 of the filler 526 are completely surrounded by the dielectric casing so that no portion of the aluminum tape 530 is exposed. Both the filler 326 with the solid extrusion of dielectric material and the encased aluminum tape filler embodiment 526 allows the cable to be provided without a ground.

Similar to the embodiment of FIG. 3, in one method of manufacture, the filler 326 of FIG. 4 is pulled straight along the length of the cable core 322 such that the shielding components 320 (or the transverse shielding portions 354) run along the length of the cable 310 without twisting about the longitudinal axis A (FIG. 1) of the cable. In the alternative, the filler 326 and the shielding components 320 may be helically twisted, at a constant or varying twist rate, about the longitudinal axis A of the cable.

Referring now to FIG. 5, the multi-pair cable 410 includes a central cable core 422 defined by a plurality of twisted conductor pairs 414 and the filler 426. A jacket 418 covers or surrounds the central cable core 422. The filler 426 separates the twisted conductor pairs 414 into one of two regions: a first region 434, and a second region 436.

The cable 410 in this embodiment is shown without discrete shielding components located radially beyond the twisted conductor pairs 414. Rather, this cable 410 includes a shielding arrangement 412 made up of only the filler 426.

In one method of making the filler 426, the length of aluminum tape 430 of the filler is extruded along with the dielectric material 432. The aluminum tape 430 of this shielding arrangement 412 aids in reducing crosstalk between adjacent cables. The dielectric material 432 of the filler 426 allows the cable to be provided without a ground.

Similar to the previous embodiment, in one method of manufacture, the filler 426 is pulled straight along the length of the cable core 422 without twisting about the longitudinal axis A (FIG. 1) of the cable. In the alternative, the filler 426 may helically twist, at a constant or varying twist rate, about the longitudinal axis A of the cable. As previously described, it is to be understood that shielding components, such as those shown in FIG. 2 (i.e., 20), or those shown in FIG. 3 (i.e., 230) and formed integral with the filler, may be incorporated into the cable arrangement of FIG. 5.

Referring now to FIG. 6, the multi-pair cable 510 includes a central cable core 522 defined by a plurality of twisted conductor pairs 514 and the filler 526. A jacket 518 covers or surrounds the central cable core 522. The filler 526 is star-shaped or cross-shaped and includes a central portion 552 having a plurality of legs 556 that define regions or pockets 534, 536, 538, 540. Each of the regions is sized to receive only one of the twisted conductor pairs 514.

Similar to the embodiment of FIG. 5, the cable 510 in this embodiment is shown without discrete shielding components located radially beyond the twisted conductor pairs 514. Rather, this cable 510 includes a shielding arrangement 512 made up of only the filler 526.

In one method of making, the lengths of aluminum tape 530 of the filler are extruded along with the dielectric material 532, which form each of the legs 556 of the filler. The aluminum tape 530 of this shielding arrangement 512 aids in reducing crosstalk between adjacent cables. The dielectric material 532 allows the cable to be provided without a ground.

Similar to the previous embodiment, in one method of manufacture, the filler 526 is pulled straight along the length of the cable core 522 without twisting about the longitudinal axis A (FIG. 1) of the cable. In the alternative, the filler 526 may helically twist, at a constant or varying twist rate, about the longitudinal axis A of the cable. As previously described, it is to be understood that shielding components, such as those shown in FIG. 2 (i.e., 20), or those shown in FIG. 4 (i.e., 330) and formed integral with the filler, may be incorporated into the cable arrangement of FIG. 6.

Figure 7:
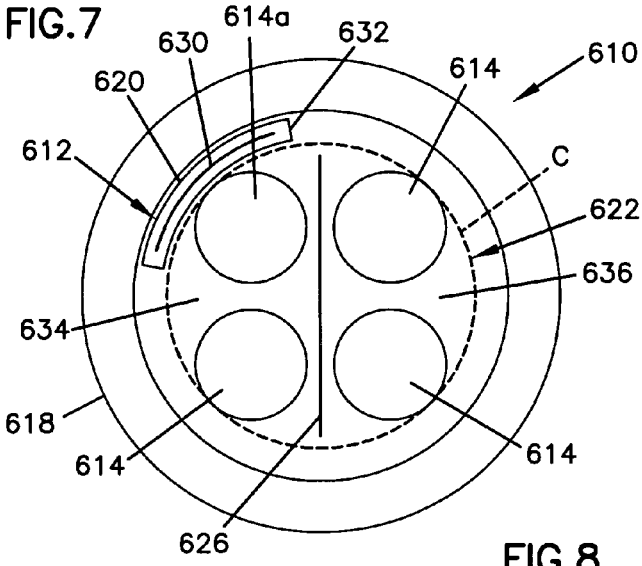
FIG. 7 is a schematic, cross-sectional view of a sixth multi-pair cable similar to that of FIG. 1, and shown with a sixth shielding arrangement embodiment, according to the principles of the present disclosure.
Figure 8:
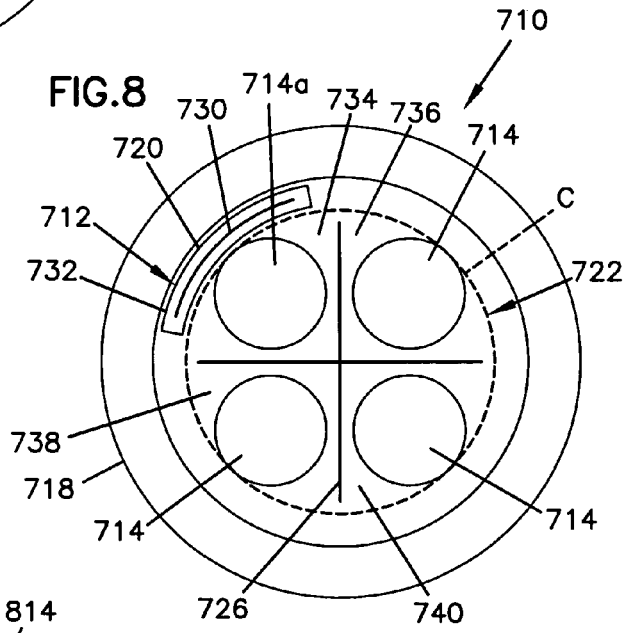
FIG. 8 is a schematic, cross-sectional view of a seventh multi-pair cable similar to that of FIG. 1, and shown with a seventh shielding arrangement embodiment, according to the principles of the present disclosure.
Figure 9:
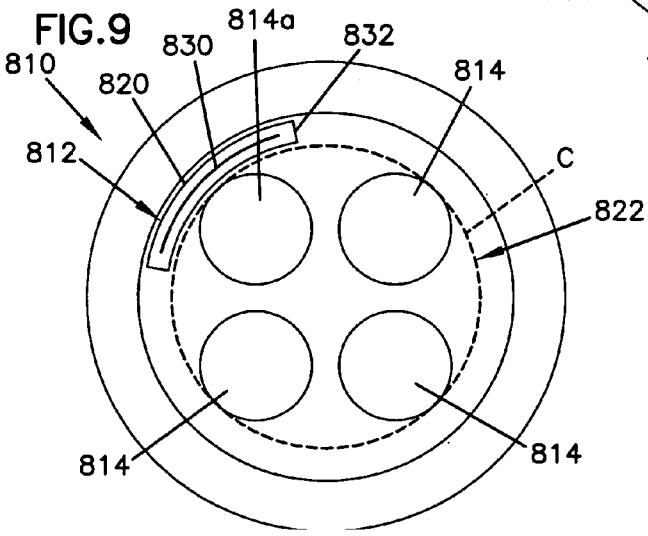
FIG. 9 is a schematic, cross-sectional view of an eighth multi-pair cable similar to that of FIG. 1, and shown with an eighth shielding arrangement embodiment, according to the principles of the present disclosure.

Referring now to FIGS. 7-9, yet other embodiments of multi-pair cables having features in accordance with the principles of the present disclosure are illustrated. Similar to the previous embodiments, and as shown in FIGS. 7 and 8, the multi-pair cables 610, 710 each include a central cable core 622, 722 at least partially defined by a plurality of twisted conductor pairs 614, 714. A jacket 618, 718 covers or surrounds the central cable core 622, 722. The cable core 622, 722 of the multi-pair cables 610, 710 further includes a spacer or filler 626, 726. The filler 626, 726 separates the twisted conductor pairs 614, 714. In the alternative, as shown in FIG. 9, a multi-pair cable 810 having a cable core 822 defined by a plurality of twisted conductor pairs 814 may be provided without a filler. Each of the cables 610, 710, 810 of FIGS. 7-9 however include a shielding arrangement 612, 712, 812 that reduces the occurrence of crosstalk between adjacent cables and thereby improves signal transmission performance of the twisted conductor pairs.

In the illustrated embodiment of FIG. 7, the filler 626 defines two regions: a first region 634 that receives two twisted conductor pairs, and a second region 636 that receives two other twisted conductor pairs. In the alternative embodiment of FIG. 8, the filler 726 is star-shaped and provides four pockets or regions 734, 736, 738, 740, each sized to receive one twisted conductor pair 714. As previously described, the fillers 626, 726 of the cables can be manufactured as solid extrusions of dielectric material. In the alternative, the fillers may be constructed to include a length or lengths of encased aluminum tape, such as shown in FIGS. 5 and 6.

Referring now to each of the cables 610, 710, 810 of FIGS. 7-9, the shielding arrangements 612, 712, 812 of each cable include a single shielding component 620, 720, 820. The shielding component 620, 720, 820 extends along the entire length of the cable such that the shielding arrangement 612, 712, 812 only partially covers a circumference C of the cable core 622, 722, 822. The single shielding component 620, 720, 820 includes a length of aluminum tape 630, 730, 830 encased in or surrounded by a dielectric material 632, 732, 832 (e.g., a dielectric casing). The dielectric material allows the cable to be provided without a ground. As previously described, the shielding component 620, 720, 830 has a generally planar or flat cross-section; and is generally flexible to permit the component to flex or bend.

The shielding component 620, 720, 820 of each of the cables 610, 710, 810 is typically associated with a particular one of the twisted conductor pairs. That is, the shielding component 620, 720, 820 runs along the length of the cable in a corresponding association with only the one twisted conductor pairs, e.g., 614*a*, 714*a*, 814*a*. The matched shielding component 620, 720, 820 and the one twisted conductor pair 614*a*, 714*a*, 814*a* may run together or in concert along the length of the cable 10 in either a twisting configuration, or in a straight run configuration. This arrangement is advantageous in applications where one identified twisted conductor pair is known to be susceptible to, or a cause of, crosstalk. The one identified twisted conductor pairs is shielded, without adding costs associated with shielding more than is needed.

In general, the multi-pair cables of the various embodiments shown in FIGS. 1-9 include twisted conductor pairs that are not individually shielded. In addition, the jacket of each cable embodiment is made of a low-cost non-shielding jacket material. Accordingly, to reduce the occurrence of alien crosstalk, the disclosed cables include a shielding arrangement that improves signal transmission performance. The overall cable designs with the disclosed shielding arrangements provides a low-cost solution to problematic crosstalk, and are particularly useful in applications where complete shielding is unnecessary.

The disclosed cable shielding arrangements further eliminate the need for a ground wire. Eliminating the ground wire also reduces the costs associated with manufacture of the cables. In addition, because the cables are not completely wrapped with shielding material, special connectors that accommodate such complete shielding are not required, which further reduces the costs associated with manufacture of the cables.

The above specification provides a complete description of the present invention. Since many embodiments of the invention can be made without departing from the spirit and scope of the invention, certain aspects of the invention reside in the claims hereinafter appended.

What is claimed is:

1. A multi-pair cable, comprising:

a) a cable core including a plurality of twisted conductor pairs, the cable core having a circumference;

b) a shielding arrangement that reduces the occurrence of crosstalk between adjacent cables, the shielding arrangement only partially covering the circumference of the cable core, the shielding arrangement including:

i) a plurality of shielding components, each of the shielding components including aluminum tape encased in a dielectric material, wherein the shielding components are separate from the cable core such that either one of the cable core and the shielding components can run straight or twist independent of the other of the cable core and the shielding components; and c) a jacket separate from and surrounding the shielding arrangement.

2. The cable of claim 1, wherein each of the individual shielding components corresponds to one of the twisted conductor pairs.

3. The cable of claim 1, wherein the shielding components run along the length of the cable without twisting about a central axis of the cable.

4. The cable of claim 1, wherein the cable core further includes a filler that separates the twisted conductor pairs.

5. The cable of claim 4, wherein the filler includes a length of aluminum tape encased in a dielectric material.

6. The cable of claim 4, wherein the filler of the cable core interconnects two or more shielding components.

7. The cable of claim 6, wherein the filler interconnects two shielding components.

8. The cable of claim 6, wherein the filler interconnects four shielding components.

9. The cable of claim 1, wherein each of the shielding components is flexible and has a generally arcuate shape when surrounded by the jacket.

10. The cable of claim 1, wherein the shielding arrangement is an un-grounded shielding arrangement.

11. The cable of claim 1, wherein gaps are provided between the plurality of shielding components of the shielding arrangement.

12. A multi-pair cable, comprising:

a) a cable core including:

i) a plurality of twisted conductor pairs; and ii) a filler separating the twisted conductor pairs of the plurality of twisted conductor pairs, the filler including:

1) a central portion and transverse shielding portions, the central portion defining only two pair-receiving regions, each of the pair-receiving regions receiving two twisted conductor pairs, the transverse shielding portions being located radially beyond the twisted conductor pairs, each of the transverse shielding portions including a length of aluminum tape encased by a dielectric material; and b) a jacket surrounding the cable core.

13. The cable of claim 12, wherein the central portion of the filler interconnects two transverse shielding portions.

14. The cable of claim 12, wherein the transverse shielding portions are located at opposite ends of the central portion.

15. The cable of claim 12, wherein the cable is un-grounded.

16. The cable of claim 12, wherein the central portion and the shielding portions of the filler define an I-shaped filler.

17. A multi-pair cable having a length, the multi-pair cable comprising:

a) a cable core including a plurality of twisted conductor pairs, the cable core having a circumference;

b) a shielding arrangement that reduces the occurrence of crosstalk between adjacent multi-pair cables, the shielding arrangement including a single shielding component, the single shielding component including aluminum tape encased in a dielectric material, wherein the single shielding component is separate from the cable core, and wherein the shielding arrangement is located only outside the circumference of the cable core; and c) a jacket surrounding the cable core and the shielding arrangement;

d) wherein the single shielding component is associated with a particular one of the twisted conductor pairs such that the single shielding component runs along the length of the cable in concert with the particular one of the twisted conductor pairs to shield only the particular one of the twisted conductor pairs.

18. The cable of claim 17, wherein the single shielding component and the particular one of the twisted conductor pairs run along the length of the cable in a twisting configuration.

19. The cable of claim 17, wherein the single shielding component and the particular one of the twisted conductor pairs run along the length of the cable without twisting about a central axis of the cable.

20. The cable of claim 17, wherein the cable core further includes a filler that separates the twisted conductor pairs.

21. The cable of claim 20, wherein the filler defines two regions, each of the regions being sized to receive two twisted conductor pairs.

22. The cable of claim 20, wherein the filler defines four regions, each of the regions being sized to receive one twisted conductor pair.

23. The cable of claim 20, wherein the filler includes a length of aluminum tape encased in a dielectric material.

24. The cable of claim 17, wherein the shielding arrangement is an un-grounded shielding arrangement.

25. A multi-pair cable having a length, the multi-pair cable comprising:

a) a cable core including a plurality of twisted conductor pairs and a filler that separates the twisted conductor pairs, the filler defining only two pair-receiving regions, each of the pair-receiving regions receiving two twisted conductor pairs;

b) a shielding arrangement that reduces the occurrence of crosstalk between adjacent multi-pair cables, the shielding arrangement including a single shielding component, the single shielding component including aluminum tape encased in a dielectric material; and c) a jacket surrounding the cable core and the shielding arrangement;

d) wherein the single shielding component is associated with a particular one of the twisted conductor pairs such that the single shielding component runs along the length of the cable in concert with the particular one of the twisted conductor pairs to shield only the particular one of the twisted conductor pairs.

* * * * *